US005439034A

United States Patent [19]

Corain et al.

[11] Patent Number: 5,439,034

[45] Date of Patent: Aug. 8, 1995

[54] MECHANISM FOR TRANSMITTING THE SELECTION COMMAND FOR THE REED BEATING POSITION IN A TERRY LOOM

[75] Inventors: Luciano Corain, Vicenza; Lucio Sardella, Schio, both of Italy

[73] Assignee: Nuovopignone - Industrie Meccaniche E Fonderia S.p.A., Florence, Italy

[21] Appl. No.: 221,255

[22] Filed: Mar. 31, 1994

[30] Foreign Application Priority Data

Apr. 7, 1993 [IT] Italy ..... MI93A0690

[51] Int. Cl.[6] ..... D03D 39/22

[52] U.S. Cl. ..... 139/26

[58] Field of Search ..... 139/26, 27

[56] References Cited

U.S. PATENT DOCUMENTS

| | | | |
|---|---|---|---|
| 3,788,359 | 1/1974 | Volpe | 139/26 |
| 4,099,546 | 7/1978 | Santucci | 139/27 |
| 4,294,290 | 10/1981 | Freisler | 139/26 |
| 4,406,308 | 9/1983 | Corain | 139/26 |

FOREIGN PATENT DOCUMENTS

| | | | |
|---|---|---|---|
| 699911 | 3/1988 | Belgium . | |
| 0350446 | 1/1990 | European Pat. Off. | 139/26 |
| 0499305 | 1/1992 | European Pat. Off. | 139/26 |
| 2373624 | 12/1976 | France . | |
| 1544474 | 4/1979 | United Kingdom . | |
| 2063933 | 6/1981 | United Kingdom . | |

*Primary Examiner*—Andrew M. Falik

*Attorney, Agent, or Firm*—Oblon, Spivak, McClelland, Maier & Neustadt

[57] ABSTRACT

A mechanism for transmitting the selection command for a reed beating position in a terry loom, the terry loom including a connecting rod, one end of which is hinged to the common articulated joint of two pivoted arms by which the support body for the toothed sector mounted on the axis of rotation of the loom sley is hinged to the lower end of the sley, the other end being hinged to the end of the rocker lever. The other end is hinged so as to lie on the axis of rotation of the sley when said rocker lever rests against the fixed shoulder of the loom.

2 Claims, 2 Drawing Sheets

MECHANISM FOR TRANSMITTING THE SELECTION COMMAND FOR THE REED BEATING POSITION IN A TERRY LOOM

BACKGROUND OF THE INVENTION

1. Field of the Invention

This invention relates to a new mechanism which, by enabling the selection command for varying the reed beating position in a terry loom to be effectively transmitted, allows the reed positions to be precisely stabilized, to hence form terries which are perfectly equal over the entire length of the terry cloth, hence obtaining terry cloth of optimum quality.

2. Background of the Discussion

More specifically, the invention relates substantially to an improvement in the device already described in our preceding U.S. Pat. No. 4,406,308 granted on Sep. 27, 1983.

As is well known, in terry looms the reed, swinging with the loom sley, must always be moved either into a normal or "closed" position in which said reed beats the inserted weft yarns against the edge of the cloth under formation, or into a position retracted from said edge or "open" position in which the inserted weft yarns are carried by the reed only into the vicinity of said edge but without them being beaten against it.

In other words, the reed beating position has to be able to be varied relative to the edge of the cloth under formation by means of a suitable device, such that the reed effects the actual beating only after a number of yarn insertions, to hence create the characteristic terry of the terry cloth.

In a device for varying the reed beating position in a terry loom, such as that described in the said U.S. Pat. No. 4,406,308, the reed is hinged to the loom sley and has its lower end connected by connecting rods to cams keyed onto a single shaft which, via a gearwheel rigid with it, engages a toothed sector supported by a body mounted so as to be idle about the axis of rotation of said sley and is hinged to the lower end of said sley by two arms pivoted to each other at a common articulated joint. Said toothed sector is then rotated relative to said cams by a rocker lever which, pivoted to a fixed part of the loom and maintained resting by means of a spring against a fixed shoulder of the loom, at which the reed is in said "closed" position, is in its turn rotated into a second position, corresponding to the reed in its "open" position, by a device which selects the movement of the rocker lever by a mechanism for transmitting the selection command.

More specifically, said selection command transmitting mechanism consists substantially of a groove provided at the end of said rocker lever, into which said common articulated joint of the two said pivoted arms is inserted and guided, said groove having a circular arc extension with its center on said axis of rotation of the sley when said rocker lever is resting against said fixed shoulder.

Although such transmission mechanism has considerable kinematic advantages an important one of which is the assurance that the reed is always specifically in its "closed" position when the sley swings into its rear dead center position, this being known to be essential in order not to have interference between the reed and the heddle frames, with consequent damage to the heddles, it has however certain drawbacks due substantially to the type of joint-groove connection used.

In this respect, in said type of connection there must always be a clearance between the joint and the groove to enable them to slide relative to each other, this inevitably resulting in imperfect and non-constant positioning of the reed in the commanded position, consequently obtaining terry cloth having an irregular terry height. Again, said clearance is also the source of an uncontrollable series of impacts and sliding of said joint against the walls of said groove under the action of the alternating loads generated during operation, consequently prejudicing the life of the connection.

SUMMARY OF THE INVENTION

The object of the present invention is to obviate said drawbacks by providing a mechanism for transmitting the selection command for the reed beating position which does not give rise to deleterious slack or sliding, hence ensuring perfect, precise and always constant positioning of the reed, consequently obtaining terries of perfectly equal height.

This is obtained substantially in that the constraint achieved by said circular arc groove is now achieved by an equivalent element consisting of a connecting rod hinged between said joint and the end of said rocker lever. Again, said hinging between said connecting rod and the end of said rocker lever must be effected such as to lie on said axis of the sley when the rocker lever rests against said fixed shoulder in order, as in the case of the circular arc groove, to ensure that the swinging of the sley does not induce relative rotation between the toothed sector and the cams, the reed hence remaining in its "closed" position. Hence, the mechanism for transmitting the selection command for the reed beating position, from a "closed" position to an "open" position and vice versa, in a terry loom comprising said reed hinged to the loom sley and connected at its lower ends, via connecting roods, to cams keyed onto a single shaft supported rotatably by said sley and, via a gearwheel rigid with it, engaging a toothed sector which, supported by a body mounted idle on the rotation axis of said sley and hinged to the lower end of said sley by two arms pivoted to each other at a common articulated joint, is rotated relative to said cams by a rocker lever which is pivoted to a fixed part of the loom, is pulled by a spring against a fixed shoulder of the loom, at which the reed is in said "closed" position, and is controlled by a movement selection device via said mechanism for transmitting the selection command, is characterized according to the present invention in that said common articulated joint of the two said pivoted arms is hinged to the end of a connecting rod the other end of which is hinged to the end-of said rocker lever, the latter hinging being such as to lie on said axis of rotation of said sley when said rocker ever rests against said fixed shoulder.

The invention is described in detail hereinafter with reference to the accompanying drawings, which show a preferred embodiment thereof by way of example only, in that technical or constructional modifications can be made thereto but without leaving the scope of the present invention.

DESCRIPTION OF THE PREFERRED EMBODIMENT

Figure 1:
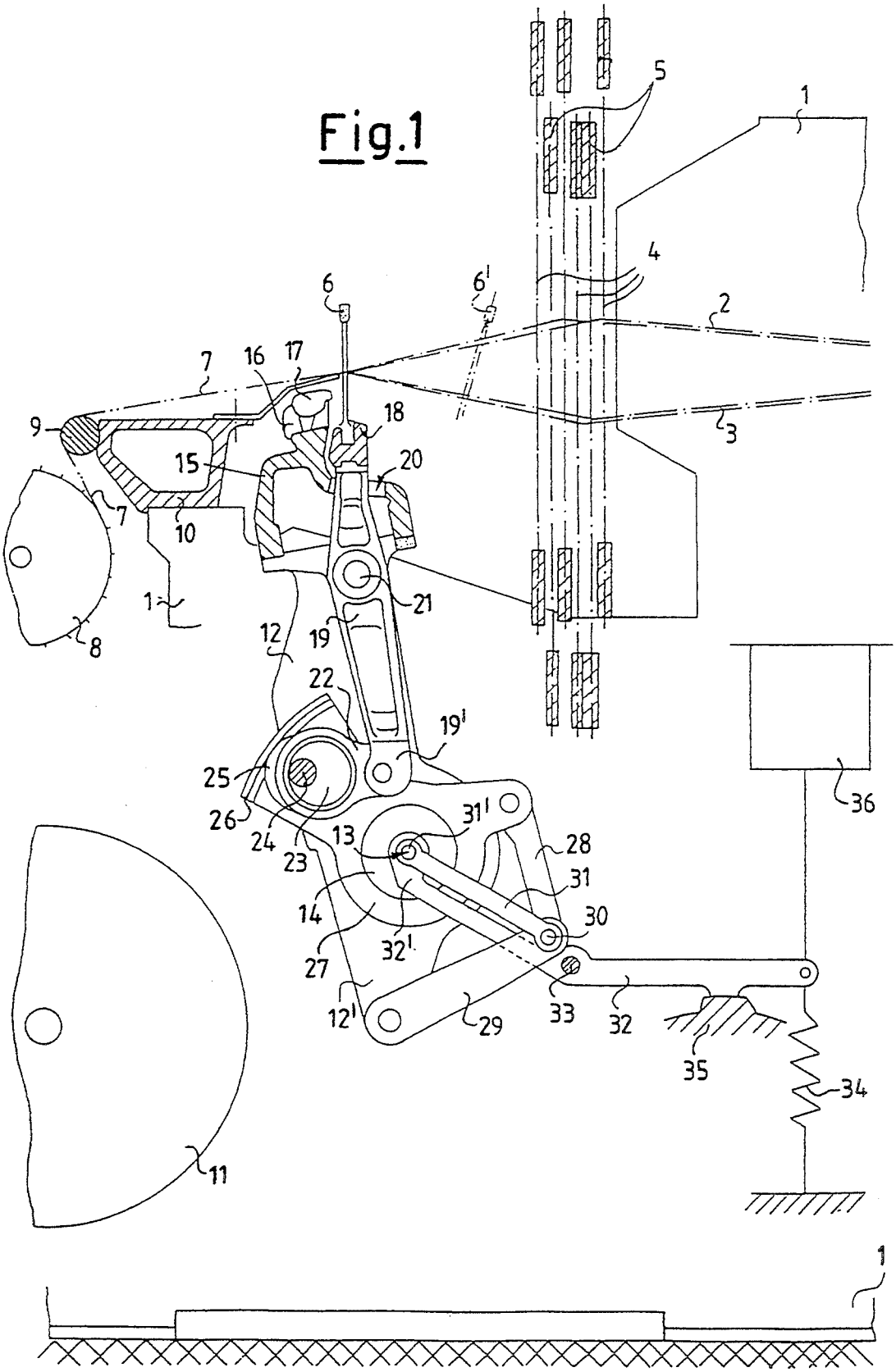
FIG. 1 is a partial schematic side sectional view of a terry loom using the mechanism for transmitting the selection command for the reed beating position according to the invention, shown with the reed in its "closed" position.

In figures the reference numeral 1 indicates the fixed frame of the terry loom or rather a sidepiece of said frame, and 2 and 3 indicate the warp yarns which are guided by the heddles 4 of the loom heddle frames 5 to cross the weft yarns not shown in the figures, and pass through the teeth of the reed 6 which swings from its rearward position 6' to its actual beating position 6 with the reed in the "closed" position and from its rearward position 6' to its retracted position 6'' with the reed in the "open" position, to form the cloth 7 which is dragged by the take-up roller 8 and slides about the drag roller 9 rotatably supported by the loom frame 10, to be wound on the cloth collection beam 11. The reference numeral 12 indicates the sley is hinged at a lower portion there a to the loom sidepieces on the axis of rotation 13 by rotation pins 14 and supports on its head bar 15 the guide 16 for the weft passage members 17 (only one member is visible in the figure, the other being at the other loom sidepiece). To be able to swing, said reed 6 is mounted rigidly on the top of a support 18, the sides 19 of which (only one being visible in the figure) are inserted through suitable slots 20 in said head bar 15 of the sley 12, the sides being also hinged to said head bar 15 by hinge pins 21. The lower end 19' of each side 19 is pivoted to the end of a connecting rod 22, the other end of which is idly mounted on a corresponding cam 23, all the cams 23 (only one is visible in the figure) being keyed onto the same shaft 24 which is rotatably supported, via means not shown in the figure, by the sley 12 in proximity to the axis of rotation 13 of this latter in order to reduce its inertia to a minimum. On said camshaft 24 there is also keyed a gearwheel 25 engaging a toothed sector 26 supported by a body 27 mounted idle about said axis of rotation 13 of the sley 12. Said body 27 is also hinged to the lower end 12' of the sley 12 by two arms respectively 28 and 29 articulatedly joined together, their common joint 30 being also pivoted to the end of a pivoted connecting rod 31, the other end of which is pivoted at 31' to the end 32' of a rocker lever 32 pivoted to the loom frame by the pin 33 and maintained resting by means of a spring 34 against a fixed shoulder 35 one,he loom frame. By suitably aligning the cams 23, the normal or "closed" position of the reed 6 is made to correspond to said position of the rocker lever 32 as shown in FIG. 1, and in addition said pivotal connection 31' between the connecting rod 31' and rocker lever 32 is made to lie precisely on the axis of rotation 13 of the sley 12 (again see FIG. 1). Finally, said rocker lever 32 is caused to rotate from the position shown in FIG. 1 to the position shown in FIG. 2 and vice versa by a movement selection device 36.

Figure 2:
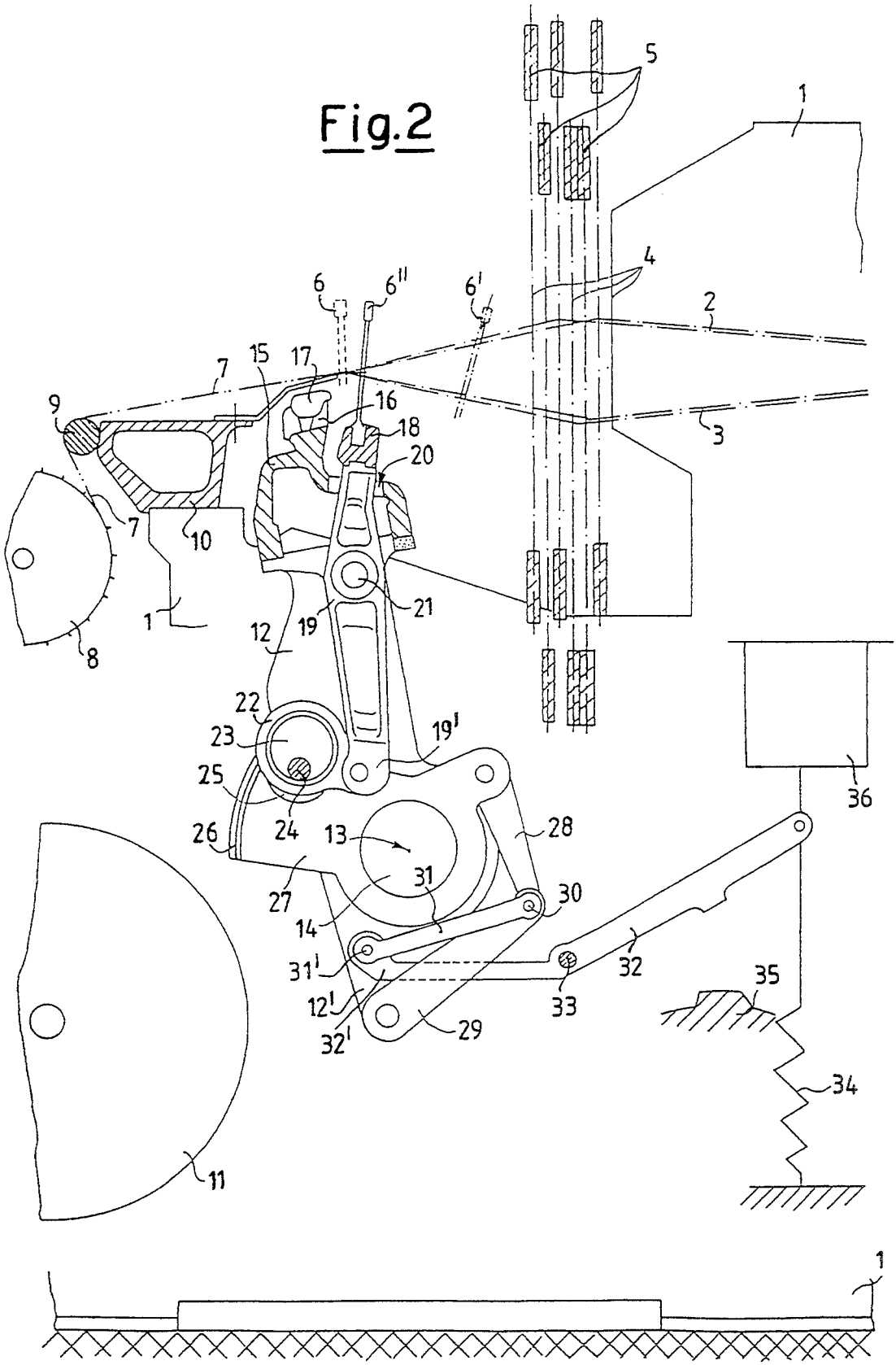
FIG. 2 is a view similar to that of FIG. 1, but with the reed in its "open" position.

Again, with the rocker lever 32 rotated into the position shown in FIG. 2, counterclockwise swinging of the sley 12 causes the joint 30 to move, by means of the arm 29, along a circular arc with its center at 31' which does not lie on the axis of rotation 13 of the sley so that a relative movement is generated between the toothed sector 26 and the slay 12 and consequently between said toothed sector 26 and the gearwheel 25, causing the cams 23 to rotate in the counterclockwise direction to determine a clockwise rotation of the reed 6, which hence moves into the position 6'' corresponding to the "open" position of the reed.

The method of operating the mechanism is now apparent.

With the rocker lever 32 rotated into the position shown in FIG. 1, the toothed sector 26 is caused to rotate by the slay 12, but as the joint 30 moves along a circular arc with its center on the axis of rotation 13 of the sley there is no relative rotation between the toothed sector 26 and the gearwheel 25, so that the reed remains continuously in its "closed" position during the entire travel of the sley.

In contrast, when the reed is in its "open" position 6'' and hence the rocker lever 32 has been rotated counterclockwise and the connecting rod 31 has been moved to the position shown in FIG. 2, rearward clockwise rotation of the slay 12 then causes the joint 30 to move clockwise along a circular arc with its center at 31', which is not on the axis of rotation 13 of the slay, with the result that the toothed sector 26 is compelled to rotate clockwise and urge the cams 23 into clockwise rotation, to hence rotate the reed from its "open" position 6'' to its "closed" position 6 when the reed reaches its rearward position 6', after which the reed returns to its "open" position during the counterclockwise forward rotation, as in effect must always be the case in order to prevent the reed being able to interfere with the heddle frames 5 and damage the heddles 4. Obviously, additional modifications and variations of the present invention are possible in light of the above teachings. It is therefore to be understood that within the scope of the appended claims, the invention may be practiced otherwise than as specifically described herein.

We claim:

1. A terry loom having a fixed part and a mechanism transmitting a selection command for a reed beating position from a closed position to an open position and vice versa, said terry loom comprising:

a fixed shoulder;

a loom sley having a rotational axis;

a body mounted on said rotational axis of said loom sley and hinged to said loom sley;

a toothed sector supported by said body;

a cam shaft having a gear wheel engaging said tooth sector;

cams keyed onto said cam shaft;

a reed hinged to said loom sley;

connecting rods connected to a lower portion of said sley and connecting said loom sley to said cams via said gear wheel;

first and second arms pivoted to one another at a common articulated joint and interconnecting said body and said loom sley;

a rocker lever pivoted to said fixed part of said loom, said lever rotating said toothed sector via said first and second arms;

a spring interconnecting the fixed part of the loom and said rocker lever;

a movement selection device connected to said rocker lever and controlling movement of said rocker lever; and a connecting rod hinging the common articulated joint of said first and second arms to an end of said rocker lever, wherein said end of the rocker lever lies on the axis of rotation of said loom sley when said rocker lever rests against said fixed shoulder and the reed beating position is in the open position.

2. A terry loom as claimed in claim 1, wherein, said movement selection device moves said rocker lever, when said reed beating position is in a closed position, so as to be spaced from said fixed shoulder and said end of said rocker lever is offset from the axis of rotation of the loom sley.

* * * * *